US008610749B2

(12) United States Patent
Kishi

(10) Patent No.: US 8,610,749 B2
(45) Date of Patent: Dec. 17, 2013

(54) DISPLAY DEVICE AND DRIVE METHOD FOR DISPLAY DEVICE

(75) Inventor: Noritaka Kishi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 24 days.

(21) Appl. No.: 13/375,769

(22) PCT Filed: Mar. 4, 2010

(86) PCT No.: PCT/JP2010/001523

§ 371 (c)(1),
(2), (4) Date: Dec. 1, 2011

(87) PCT Pub. No.: WO2010/140285

PCT Pub. Date: Dec. 9, 2010

(65) Prior Publication Data

US 2012/0075361 A1 Mar. 29, 2012

(30) Foreign Application Priority Data

Jun. 4, 2009 (JP) ..... 2009-135286

(51) Int. Cl.
*G09G 5/02* (2006.01)

(52) U.S. Cl.
USPC ..... 345/690

(58) Field of Classification Search
USPC ..... 345/685–695
See application file for complete search history.

(56) References Cited

U.S. PATENT DOCUMENTS 6,583,775 B1 6/2003 Sekiya et al.
6,903,716 B2 * 6/2005 Kawabe et al. ..... 345/99
7,283,108 B2 * 10/2007 Kasai ..... 345/76
8,063,855 B2 * 11/2011 Takahara et al. ..... 345/76
2004/0113873 A1 6/2004 Shirasaki et al.
2004/0155841 A1 8/2004 Kasai
2004/0222950 A1 11/2004 Kimura (Continued)

FOREIGN PATENT DOCUMENTS

EP 1424680 A2 6/2004
JP 2001-60076 A 3/2001

(Continued)

OTHER PUBLICATIONS

International Search Report and Written Opinion received for PCT Patent Application No. PCT/JP2010/001523, mailed on May 11, 2010, 14 pages (7 pages of English translation and 7 pages of Search Report and Written Opinion).

(Continued)

*Primary Examiner* — William Boddie
*Assistant Examiner* — Bipin Gyawali
(74) *Attorney, Agent, or Firm* — Morrison & Foerster LLP

(57) ABSTRACT

A pixel circuit (6) is driven in an impulse mode in which an organic EL diode (7) emits light only during a selection period, or in a hold mode in which the organic EL diode (7) emits the light not during the selection period but after the selection period. Moreover, the pixel circuit (6) is provided with a programmed current source (I1) for lower-side gray scale display and a programmed current source (I2) for higher-side gray scale display, the pixel circuit (6) being supplied with a programmed current (I) from the programmed current source (I1) when the pixel circuit (6) is driven in the impulse mode, and a programmed current (I') from the programmed current source (I2) when the pixel circuit (6) is driven in the hold mode.

13 Claims, 9 Drawing Sheets

(56) References Cited

U.S. PATENT DOCUMENTS

| | | | | |
|---|---|---|---|---|
| 2005/0007509 | A1* | 1/2005 | Yamazaki et al. | 349/41 |
| 2006/0066219 | A1* | 3/2006 | Shimoda et al. | 313/500 |
| 2006/0158410 | A1 | 7/2006 | Fujine | |
| 2006/0267886 | A1 | 11/2006 | Ozaki et al. | |
| 2009/0002281 | A1* | 1/2009 | Okamoto et al. | 345/76 |
| 2010/0309096 | A1* | 12/2010 | Inoh | 345/5 |

FOREIGN PATENT DOCUMENTS

| | | | |
|---|---|---|---|
| JP | 2003-195810 | A | 7/2003 |
| JP | 2004-317677 | A | 11/2004 |
| JP | 2004-361935 | A | 12/2004 |
| JP | 2007-248800 | A | 9/2007 |
| JP | 2009-9049 | A | 1/2009 |

OTHER PUBLICATIONS

International Preliminary Report on Patentability received for PCT Patent Application No. PCT/JP2010/001523, mailed on Dec. 15, 2011, 12 pages (7 pages of English Translation and 5 pages of IPRP).

Extended European Search Report and European Search Opinion received for European Patent Application No. 10783073.9, mailed on Nov. 26, 2012, 7 pages.

* cited by examiner

DISPLAY DEVICE AND DRIVE METHOD FOR DISPLAY DEVICE

CROSS REFERENCE TO RELATED APPLICATIONS

This is a U.S. National Phase patent application of PCT/JP2010/001523, filed Mar. 4, 2010, which claims priority to Japanese Patent Application No. 2009-135286, filed Jun. 4, 2009, each of which is hereby incorporated by reference in the present disclosure in its entirety.

TECHNICAL FIELD

The present invention relates to a display device and a drive method for driving the display device.

BACKGROUND ART

In order to drive a light emitting element (such as organic EL, light emitting diodes etc.) controlled by an electric current, that is, to drive an electric current element, accurate control of the electric current to be supplied to the electric current element is required in a range from minute electric currents for low gray scales to large electric currents for high gray scales. If a conventional simple matrix drive is employed to an organic EL display device, high luminance drive is required especially in a high gray scale region due to a low duty ratio, thereby shortening a life of the organic EL display device. For this reason, an active matrix drive using TFT is mainly employed.

By utilizing a signal programmed in a selection period, the active matrix drive makes it possible to perform the driving in a hold mode in which light is emitted also during a non-selection period other than the selection period.

Recently, organic EL elements have been improved to be more efficient, thereby requiring that more minute electric current should be controlled more accurately at a higher speed. Various driving methods have been proposed, but none of them is a breakthrough solution. Thus, it is expected that a demand for a driving technique for coping with finer resolutions and gray scale increases will be higher.

FIG. 9 is a circuit diagram illustrating a conventional driving circuit described in Patent Literature 1. In the driving circuit illustrated in FIG. 9, a gate electrode of a transistor 10 is connected with a scanning line Xi, a drain electrode of the transistor 10 is connected with a drain electrode of a transistor 12. The drain electrode of the transistor 12 is connected with a power source line Vi. A gate electrode of the transistor 12 is connected with a source electrode of the transistor 10. A source electrode of the transistor 12 is connected with a drain electrode of a transistor 11 and with anodes of organic EL elements Ei and Ej. A gate electrode of the transistor 11 is connected with the scanning line Xi, and a source electrode of the transistor 11 is connected with a signal line Yj.

During a selection period, a power source signal voltage is applied on the power source line Vi. The power source signal voltage is equal to or lower than a reference potential Vss. When the scanning line Xi becomes H (high) during the selection period, the transistors 10 to 12 are turned on. Meanwhile, a voltage across each organic EL element Ei and EJ becomes 0 or reversely biased. Thus, a programmed sink current Ij flows in a path indicated by the arrow $\alpha$.

When the transistor 12 is turned on in the selection period, a gate-source voltage Vgs determined according to a driving capacity of the transistor 12 is applied on a capacitor 13. By this, an electric charge corresponding to the gate-source voltage Vgs is stored in the capacitor 13.

After that, in a non-selection period in which the scanning line Xi becomes L (low) after the selection period is ended, the capacitor 13 thus charged during the selection period applies a positive voltage across the gate and source of the transistor 12, thereby turning on only the transistor 12.

Moreover, a power source signal voltage to be applied on the power source line Vi during the non-selection period is a power source voltage Vdd that is sufficiently higher than the reference potential Vss. Thus, a forwardly biased voltage is applied on the organic EL elements Ei and Ej. The transistor 12 supplies the organic EL elements with a constant electric current whose ampere is equal to Ij. That is, it is possible to supply a constant electric current to the organic EL elements Ei and Ej even if the transistors 12 are uneven in terms of properties.

CITATION LIST

Patent Literature

Patent Literature 1
Japanese Patent Application Publication, Tokukai, No. 2003-195810 (Publication Date: Jul. 9, 2003)

SUMMARY OF INVENTION

Technical Problem

The current programming in the driving circuit illustrated in FIG. 9 uses an electric current source as the signal source. However, it is difficult to realize an electric current source capable of controlling minute currents of an order of several ten nA. Further, in case where the programming is carried out with such a minute electric current as above, it is time-consuming to charge a parasite capacitor of lines or a pixel circuit with the minute electric current. As a result, a writing period will not be long enough.

On the other hand, in the driving circuit of FIG. 9, the programming the voltage by using a voltage source as the signal source does not have the problem of not enough wiring time. However, the light emitting ampere becomes more minute in association with the improvement of the EL elements to be more efficient, such as development of fluorescent materials. Meanwhile, the driving transistor for converting a programming voltage into a light emitting current is a TFT. As a result of technical development to improve the TFT in mobility, the TFT has become able to provide a greater current amplitude from a smaller voltage change. As a result, it has become necessary to control a more minute voltage in order to control a more minute current. It is difficult to accurately supply such a minute voltage.

To overcome this problem, a technique may be sometimes adopted, in which black is inserted in a later half of a frame in order to increase luminance in a light emitting period. This is because the luminance seems to be identical apparently as long as luminance integral value is constant in a frame period.

However, the black insertion would not be sufficient to solve the difficulty of the current control. In such a case, it is necessary to perform control of a minute current of several 10 nA in the hold mode.

This current control converts a voltage value to a current value by using a driving TFT in a current pixel, so as to supply a control current to the EL element. However, an influence of uneven threshold among TFTs becomes greater in the minute current ranges. Therefore, it is considered that it will be difficult to provide a highly sensitive driving TFT for controlling such a minute current.

It is known that, if the driving is carried out with further brighter instant luminance and a longer black period in order to overcome this drawback, it becomes necessary to significantly increase the brightness of the higher-side gray scales during the light emitting period, thereby resulting in a shorter light of the organic EL element.

The present invention was accomplished in view of the aforementioned problem and an object of the present invention is to provide a display device and a drive method for the display device, in each of which gray scale control can be performed more easily than conventional gray scale control, a longer life of the organic EL element can be achieved by lowering the instant luminance, and a lower power consumption can be achieved.

Solution to Problem

In order to attain the object, a display device according to the present invention is a display device including a plurality of scanning lines extended in one direction, a plurality of data signal lines extended in another direction, a source driver circuit for driving the plurality of data signal lines, a gate driver circuit for controlling the plurality of scanning lines, and a pixel provided correspondingly to each intersection between the plurality of scanning lines and the plurality of data signal lines, each pixel being provided with an element for emitting light with luminance depending on an electric current supplied to the element, where a selection period of a scanning line is a period in which the scanning line is selected by the gate driver circuit, the display device including: a pixel circuit per pixel, the pixel circuit being driven in an impulse mode in which the element emits the light only during the selection period, or in a hold mode in which the element emits the light not during the selection period but after the selection period, the pixel circuit being provided with a first signal source for supplying a light emitting signal when the pixel circuit is driven in the impulse mode, and a second signal source for supplying a light emitting signal when the pixel circuit is driven in the hold mode.

In order to attain the object, a drive method according to the present invention is a drive method for a display device including a plurality of scanning lines extended in one direction, a plurality of data signal lines extended in another direction, a source driver circuit for driving the plurality of data signal lines, a gate driver circuit for controlling the plurality of scanning lines, and a pixel provided correspondingly to each intersection between the plurality of scanning lines and the plurality of data signal lines, each pixel being provided with an element for emitting light with luminance depending on an electric current supplied to the element, where a selection period of a scanning line is a period in which the scanning line is selected by the gate driver circuit, the drive method including: driving a pixel circuit of the pixel in an impulse mode in which the element emits the light only during the selection period; driving the pixel circuit in a hold mode in which the element emits the light not during the selection period but after the selection period; supplying a light emitting signal from a first signal source when the pixel circuit is driven in the impulse mode; and supplying a light emitting signal from a second signal source when the pixel circuit is driven in the hold mode.

According to the present invention, if a pixel is to display in a lower-side gray scale, the pixel is driven in the impulse mode for attaining easy gray scale control, and if a pixel is to display in a higher-side gray scale, the pixel is driven in the hold mode for attaining a longer life.

With this, the second signal source supplies the light emitting signal in case the driving is carried out in the hold mode. This allows the ampere value for the lowest gray scale to be larger than conventional gray scale control, thereby making it possible to perform the gray scale control more easily than the conventional gray scale control.

Meanwhile, the first signal source supplies the light emitting signal in case the driving is carried out in the impulse mode. This allows the ampere value for the highest gray scale to be smaller than the conventional gray scale control, thereby making it possible to prolong the life of the device.

Especially in a display device with high resolution, if the gray scale range driven in the impulse mode is small and the gray scale rage driven in the hold mode is large, the current control can be carried out by effectively utilizing the ranges of the gray scales.

Further, compared with the conventional art, the present invention has the following advantages. A first advantage is that it becomes unnecessary to change the timing of the data output, thereby making it possible to further simplify the configuration of the control circuit in the gate driver circuit. A second advantage is that it is possible to perform the light emission during the whole selection period, a longer life is achieved by reducing the instant luminance.

A third advantage is that the technology described in the present embodiment is useful in achieving lower power consumption. In the hold mode of the conventional driving circuit, the current is supplied to the organic EL element through the driving transistors continuously. If a driving transistor is driven in a saturation region, a voltage drop occurs across the driving transistor. The voltage drop causes an energy to be consumed in heat release rather than in the light emission, thereby wasting the energy. On the other hand, in the impulse mode, the light emission current is supplied via a switching element operating in a linear region, thereby reducing the power loss as small as possible. That is, compared with the hold mode of the conventional driving circuit, it is possible to reduce the power loss in case where the driving is carried out in the impulse mode. Thus, it becomes possible to realize a display device whose power consumption is reduced.

Advantageous Effects of Invention

As described above, a display device according to the present invention is configured such (i) that the pixel circuit of each pixel is driven either in the impulse mode in which the element emit the light only during the selection period, or in the hold mode in which the element emits the light not during the election period but after the selection period, and (ii) that the pixel circuit is provided with the first signal source for supplying the light emitting signal when the pixel is driven in the impulse mode, and the second signal source for supplying the light emitting signal when the pixel is driven in the hold mode.

Moreover, a drive method according to the present invention for driving the display device is, as described above, a drive method including: driving a pixel circuit of the pixel in an impulse mode in which the element emits the light only during the selection period; driving the pixel circuit in a hold mode in which the element emits the light not during the selection period but after the selection period; supplying a light emitting signal from a first signal source when the pixel circuit is driven in the impulse mode; and supplying a light emitting signal from a second signal source when the pixel circuit is driven in the hold mode.

With these arrangements, it becomes possible to provide a display device and a drive method for the display device, in each of which gray scale control can be performed more easily than conventional gray scale control, a longer life of the device can be achieved by lowering the instant luminance, and a lower power consumption can be achieved.

DESCRIPTION OF EMBODIMENTS

One embodiment of the present invention is described below, referring to Examples 1 to 3 and FIGS. 1 to 8. To begin with, a configuration of a display device 1 according to the embodiment of the present invention.

Configuration of Display Device

Figure 3:
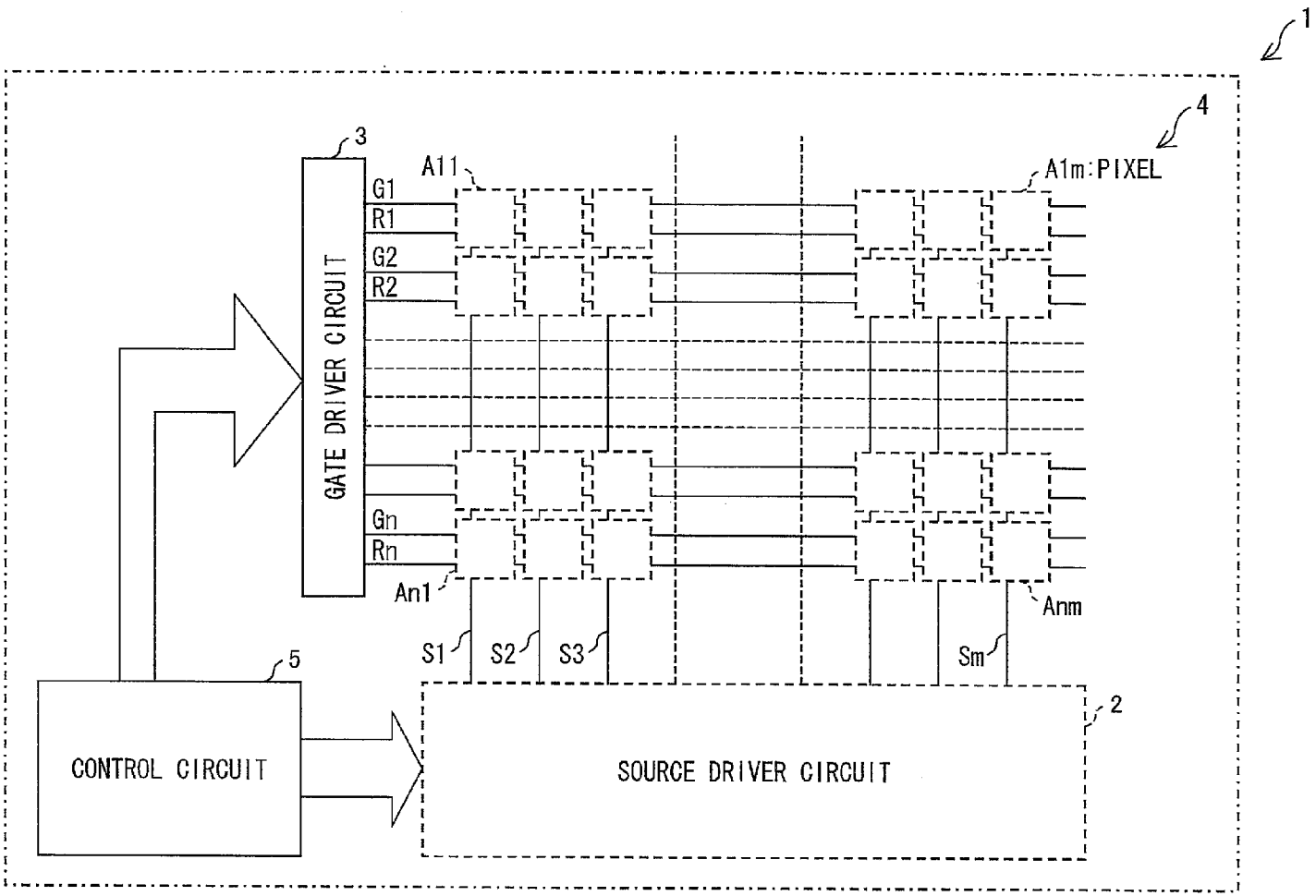
FIG. 3 is a block diagram illustrating a display device according to the Example of the present invention.

FIG. 3 is a block diagram illustrating a configuration of the display device 1 according to the present embodiment. The display device 1 includes a source driver circuit 2 for driving a plurality of (an m number of) data signal lines S1, S2, . . . , Sm, and a gate driver circuit 3 for controlling a plurality of (an n number of) scanning lines G1, G2, . . . , Gn and a plurality of (an n number of) scanning lines R1, R2, . . . , Rn, and a display section 4 having a plurality of (an m×n number of) pixels A11, . . . , A1*m*, . . . , An1, . . . Anm, and a control circuit 5 for controlling the source driver circuit 2 and the gate driver circuit 3.

The source driver circuit 2 includes a shift register, a data latch section, and a switch section and is configured to supply a voltage signal or a current signal to a selected column. The gate driver circuit 3 includes a shift register, a data latch section, and a switch section, like the source driver circuit 2, and is configured to control the scanning lines G1, G2, . . . , Gn and the scanning lines R1, R2, . . . , Rn. The gate driver circuit 3 is configured to supply a control signal to a selected row. The control circuit 5 is configured to output a control clock or a start pulse. The shift registers of the source driver circuit 2 and the gate driver circuit 3 are configured to output signals to select the column or row.

The display section 4 of the display device 1 includes the n number of scanning lines G1 to Gn, the m number of data signal lines S1 to Sm crossing the n number of scanning lines G1 to Gn, and the m×n number of pixels A11, . . . , A1*m*, . . . , An1, . . . Anm, provided correspondingly to intersections between the n number of scanning lines G1 to Gn and the m number of data signal lines S1 to Sm. The pixels may be picture elements. The pixels A11, . . . , A1*m*, . . . , An1, . . . Anm are provided in matrix, thereby constituting a pixel array. In the following, a direction in which the scanning lines are extended is referred to as a row direction, and a direction in which the data signal lines are extended is referred to as a column direction.

In Examples 1 to 3, pixel circuits of the pixels A11, . . . , A1*m*, . . . , An1, . . . Anm are described in terms of their configuration and operation.

Example 1

Figure 1:
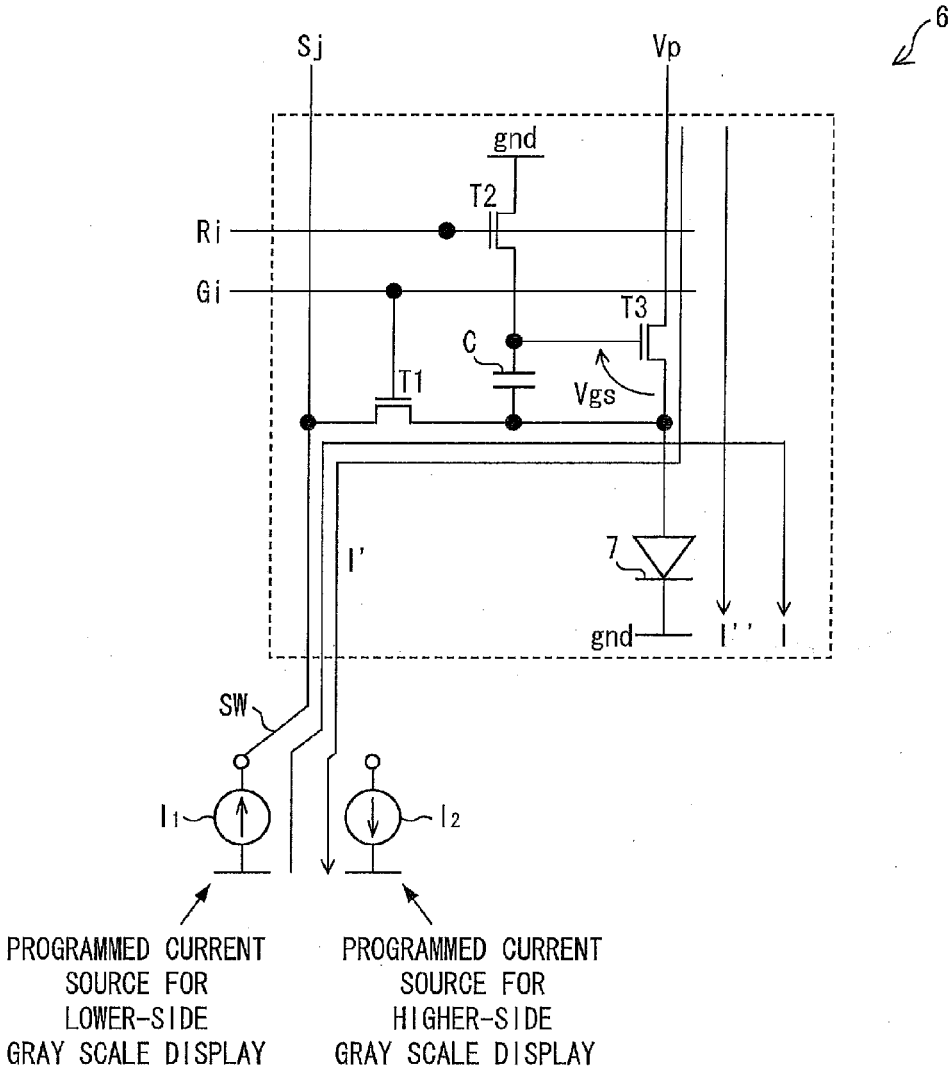
FIG. 1 is a circuit diagram of a pixel circuit according to an Example of the present invention.
Figure 2:
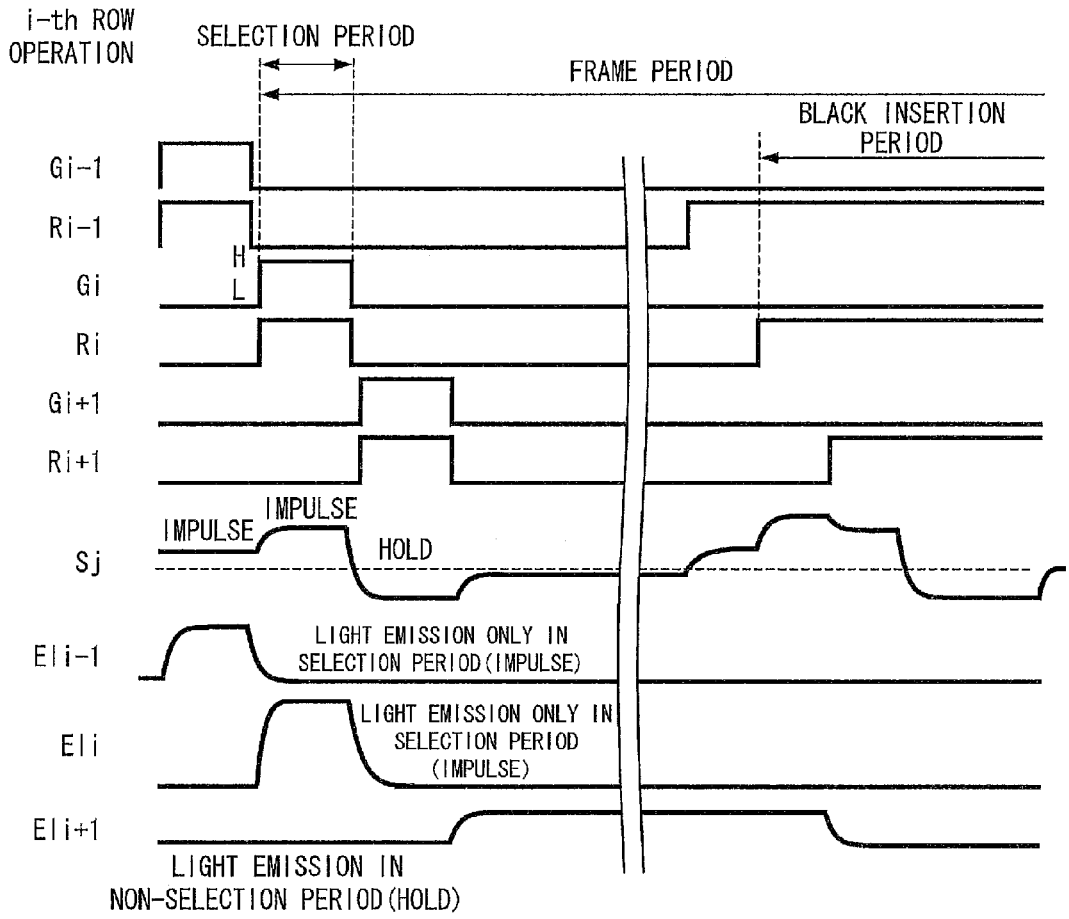
FIG. 2 is a timing chart showing operation of the pixel circuit according to the Example of the present invention.

FIG. 1 is a circuit diagram of a pixel circuit 6 according to Example 1. FIG. 2 is a timing chart illustrating an operation of the pixel circuit 6 according to Example 1. Firstly, a configuration of the pixel circuit 6 is explained below, referring to FIG. 1.

The pixel circuit 6 is a pixel circuit provided for a pixel Aij provided correspondingly to intersections between an i-th scanning line Gi and a j-th data signal line Sj and between an i-th scanning line Ri and the j-th data signal line Sj, where i=1 to n and j=1 to m.

The pixel circuit 6 includes an organic EL (Electro luminescence) diode element 7 (a element for emitting light at a luminance that is dependent on a current flowing the organic EL diode 7), a thin film transistor (TFT) T1 to T3, and a capacitor C. The TFT T1 to T3 may be N-channel TFTs, so as to allow employ an amorphous silicon panel in the display device 1, which amorphous silicon panel has a difficulty of adopting P-channel TFTs.

In the pixel circuit 6, the TFT T1 has a gate connected to the i-th scanning line Gi. The TFT T2 has a gate connected to the i-th scanning line Ri. The TFT T3 has a gate connected with a source of the TFT T2 and one end of the capacitor C. The TFT T3 has a drain connected with a power source line Vp.

The TFT T3 has a source connected with a drain of the TFT T1, another end of the capacitor C, and an anode of the organic EL diode 7. The TFT T1 has a source connected with a j-th data signal line Sj.

A drain of the TFT T2 and a cathode of the organic EL diode 7 are electrically grounded.

The j-th data signal line Sj is connected with a programmed current source I1 for the lower-side gray scale display, in case where the pixel Aij is to display at a lower-side gray scale. On the other hand, the j-th data signal line Sj is connected with a programmed current source I2 for the higher-side gray scale display, in case where the pixel Aij is to display at a higher-side gray scale. Switching-over between connecting the j-th data signal line Sj with the current source I1 and connecting the j-th data signal line Sj with the current source I2 is performed by using a switch SW. The later-described source driver circuit 2 as illustrated in FIG. 3 includes the current sources I1 and I2, and the switch SW.

The operation of the pixel circuit 6 as such is explained below, referring to the timing charge of FIG. 2.

As a start of a "selection period" of a selected row, signal levels of the scanning lines Gi and Ri of the selected row are changed from L (low) to H (high). The signal levels change from H to L at an end of the selection period.

The pixel circuit 6 is driven in the impulse mode when the pixel Aij displays at a lower-side gray scale. That is, the pixel circuit 6 is driven to cause the organic EL diode 7 to emit light only during the selection period. More specifically, in FIG. 2, sourcing of the programmed current I is performed, that is, the j-th data signal line Sj is connected to the programmed current source I1 for the lower-side gray scale display.

In this case, a potential corresponding to the data of the data signal line Sj becomes positive, and a potential at the source of the TFT T1 is positive. Moreover, during the selection period, potentials at the TFTs T1 and T2 are turned on. Accordingly, the drain of the TFT T1, the another end of the capacitor C and the anode of the organic EL diode 7 become positive because they receive the positive potential from the source of the TFT T1. The gate of the TFT T3 and the one end of the capacitor C are electrically grounded to have a ground potential.

As a result of this, the organic EL diode 7 receives a forward biased voltage is applied, thereby the organic EL diode 7 is turned on. Moreover, a gate-source voltage Vgs of the TFT T3 becomes negative, thereby turning off the TFT T3.

Consequently, the programmed current I flows in a route as follows: an output terminal of the programmed current source I1 for the lower-side gray scale display→the data signal line Sj→the source of the TFT T1→the drain of the TFT T1→the anode of the organic EL diode 7→the cathode of the organic EL diode 7. As a result, the organic EL diode 7 emits light.

Meanwhile, the TFT T1 does not start output of a drain current immediately in response to the change of the signal level of the scanning line Gi from L to H. It takes a delay time and a rising time for the drain current of the TFT T1 to reach its saturation. The delay time and the rising time will be explained later. Due to this feature of the TFT T1, a current waveform Eli of the organic EL diode 7 (i-th row) and a current waveform Eli−1 of the organic EL diode 7 (i−1th row) slowly raise during the delay time and the rising time.

The luminance of the light emission of the organic EL diode 7 is determined by an ampere value of the programmed current I set by the programmed current source I1 for the lower-side gray scale display. The ampere value of the programmed current I and the gray scale value are in a proportional relationship.

After the end of the selection period, the TFTs T1 and T2 are turned off, thereby not allowing the flow of the programmed current I. Moreover, the gate-source voltage Vgs of the TFT T3 becomes 0 or negative, thereby turning off the TFT T3. As a result, the organic EL diode 7 is turned off.

The TFT T1 is not turned off immediately in response to the change of the signal level of the scanning line Gi from H to L. It takes a delay time and a falling time for the TFT T1 to be turned off. Due to this feature of the TFT T1, a current waveform Eli of the organic EL diode 7 (i-th row) and a current waveform Eli−1 of the organic EL diode 7 of (i−1th row) slowly fall during the delay time and the falling time.

In the explanation above, the delay time is a time period from a time when an ideal pulse of the drain current of a TFT appears to a time when an amplitude of an actual pulse of the drain current becomes 10%, or a time period from the time when an amplitude of an actual pulse of the drain current becomes 10%, to a time when the amplitude becomes 0. Moreover, the rising time is a time period in which the amplitude becomes 90% from 10%. Further, the falling time is a time period in which the amplitude becomes 10% from 90%.

While the current waveform Eli in FIG. 2, is a current waveform of the pixel Aij controlled by the scanning lines Gi and Ri, it should be noted that not all the pixels controlled by the scanning lines Gi and Ri are driven in the impulse mode. Among the pixels associated with the data signal line Sj, there are pixels driven in the impulse mode and the pixels driven in the hold mode. In order to perform black insertion for the pixels driven in the hold mode, a black insertion period is provided in which the signal level of the scanning line Gi is set to L and the signal level of the scanning line Ri is set to H.

Next, the pixel circuit 6 is driven in the hole mode when the pixel Aij displays at a higher-side gray scale. That is, the pixel circuit 6 is configured to cause the organic El diode 7 to emit the light not during the selection period but after the selection period. More specifically, the programmed current I' in FIG. 2 is sunk. That is, the j-th data signal line Sj is connected to the programmed current source I2 for the higher-side gray scale display.

In this case, the potential of the data signal line Sj is negative and the potential at the source of the TFT T1 is negative. Moreover, the TFTs T1 and T2 are turned of during the selection period. Accordingly, the drain of the TFT T1, the another end of the capacitor C and the anode of the organic EL diode 7 become negative because they receive the negative potential from the source of the TFT T1. The gate of the TFT T3 and the one end of the capacitor C are electrically grounded to have a ground potential.

As a result of this, the organic EL diode 7 receives a reverse biased voltage is applied, thereby the organic EL diode 7 is turned off. Moreover, the gate-source voltage Vgs of the TFT T3 becomes positive, thereby turning on the TFT T3.

Consequently, the programmed current I' flows in a route as follows: the power source line Vp→the drain of the TFT T3→the source of the TFT T3→the drain of the TFT T1→the source of the TFT T1→the data signal line Sj→an input terminal of the programmed current source I2 for the higher-side gray scale display→an output terminal of the programmed current source I2 for the higher-side gray scale display. The programmed current I' has an ampere value corresponding to the gray scale value. The ampere value of the programmed current I' is set by the programmed current source I2 for the higher-side gray scale display.

After the end of the selection period, the source potential of the TFT T3 is changed in accordance with the anode potential of the organic EL diode 7. Moreover, the gate potential of the TFT T3 follows the change of the source potential of the TFT T3 so as to keep the gate-source voltage Vgs of the TFT T3 constant. This is caused because the TFT T2 is turned off and thereby is in a floating state.

The gate-source voltage Vgs of the TFT T3 in the selection period is maintained even after the selection period because the capacitor C charged with the gate-source voltage Vgs during the selection period. Because of this the TFTs T1 and T2 are turned off after the selection period, while the TFT T3 is kept on after the selection period.

As a result, the programmed current I", whose ampere value is substantially identical with that of the programmed current I' flowing in the selection period, flows in a route as follows: the power source Vp→the drain of the TFT T3→the source of the TFT T3→the anode of the organic EL diode 7→the cathode of the organic EL diode 7.

However, the TFT T1 is not turned off immediately in response to the change of the signal level of the scanning line Gi from H to L. It takes a delay time and a falling time of the TFT T1 to turn off. Thus, the current waveform Eli+1th of the organic EL diode 7 (i+1th row) slowly falls during the delay time and the falling time.

In case where black is inserted after the end of the selection period, the signal level of the scanning line Gi is set to L and the signal level of the scanning line Ri is set to H. By this, the TFT T1 is turned off and the TFT T2 is turned on. Because the TFT T2 is turned on, the gate potential of the TFT T3 is grounded thereby turning off the TFT T3. Because the TFT T3 is turned off, the programmed current I" does not flow, thereby turning off the organic EL diode 7.

The TFT T3 is not turned off immediately in response to a change of the signal level of the scanning line Ri from L to H. It takes a delay time and a falling time for the drain current of the TFT T3 to turn off. Because of this, the current waveform Eli+1 of the organic EL diode 7 slowly falls during the delay time and the falling time.

In the pixel circuit 6 of Example 1, the direction of the programmed current I flowing in the date signal line Sj in the impulse mode and the direction of the programmed current I' flowing in the data signal line Sj in the hold mode are opposite with in each other along the data signal line Sj.

By this, it is possible to distinguish the impulse mode and the hold mode by referring to the direction of the programmed current.

Both in the impulse mode and hold mode, the data output can be in the same timing as the start and end of the selection period. Thus, it is not necessary to complicate the circuit for controlling the timing of the data output.

Further, the luminance of the EL element is controlled by the current directly flowing the EL element. Therefore, it is possible to attain uniform luminance distribution that is not influenced by unevenness (individual differences) of the driving TFTs used for driving the pixel circuit.

Note that the "Selection Period", "Frame Period", "Black Insertion Period" etc. in FIG. 2 are those of the i-th row.

The present invention proposes an arrangement in which, if the pixel Aij is to display at a lower-side gray scale, the pixel Aij is driven in the impulse mode for easy gray scale control and if the pixel Aij is to display at a higher-side gray scale, the pixel Aij is driven in the hold mode for longer life, where the whole gray scales are classified into the lower-side gray scales and the higher-side gray scales.

In Example 1, as illustrated in Table 1 below, the whole gray scales are 0 to 255 gray scales. For 0 to 32 gray scales, the driving is carried out in the impulse mode. For 33 and greater gray scales, the driving is carried out in "the hold mode in which black is inserted in 90% of one frame period".

For black, that is, 0 gray scale, the driving can be carried out either in the impulse mode or the hold mode.

TABLE 1

Ampere Value For Light Emission in Impulse/Hold mode
*The hold mode is 90% black insertion hold mode in which the white current = 10 μA.

| Gray scales | Impulse (μA) | Hold (μA) |
|---|---|---|
| 255 | 1076 | 10.0 |
| 128 | 540 | 5.0 |
| 64 | 270 | 2.5 |
| 33 | 139 | 1.29 |
| 32 | 135 | 1.25 |
| 16 | 68 | 0.63 |
| 8 | 34 | 0.31 |
| 4 | 17 | 0.16 |
| 2 | 8 | 0.08 |
| 1 | 4.2 | 0.04 |

*Assuming that the number of lines = 1080.

In this driving method, the ampere value for the lowest gray scale is 4.2 μA, while the ampere value for the lowest gray scale was 40 nA if the driving for the lowest gray scale is carried out in the hold mode. This makes it easier to carry out the gray scale control.

In this driving method, the ampere value for the largest gray scale is 10 μA, while the ampere value for the largest gray scale was 1 mA or greater if the driving for the largest gray scale is carried out in the impulse mode. This provides a longer life than the conventional art.

Especially in a display device with high resolution, if the gray scale range driven in the impulse mode is small and the gray scale rage driven in the hold mode is large, the current control can be carried out by effectively utilizing the ranges of the gray scales. If the range of the gray scales driven in the impulse mode is larger, the ampere value necessary to perform the driving is increased and it becomes necessary to flow a large current instantly. Thus, it is not preferable that the range of the gray scales driven in the impulse mode is larger.

Further, compared with the conventional art, the present invention has the following advantages. A first advantage is that it becomes unnecessary to change the timing of the data output, thereby making it possible to further simplify the configuration of the control circuit in the gate driver circuit. A second advantage is that it is possible to perform the light emission during the whole selection period, a longer life is achieved by reducing the instant luminance.

A third advantage is that the technology described in the present embodiment is useful in achieving lower power consumption. In the hold mode of the conventional driving circuit, the current is supplied to the organic EL element through the driving transistors continuously. If a driving transistor is driven in a saturation region, a voltage drop occurs across the driving transistor. The voltage drop causes an energy to be consumed in heat release rather than in the light emission, thereby wasting the energy. On the other hand, in the impulse mode, the light emission current is supplied via a switching element operating in a linear region, thereby reducing the power loss as small as possible. That is, compared with the hold mode of the conventional driving circuit, it is possible to reduce the power loss in case where the driving is carried out in the impulse mode. Thus, it becomes possible to realize a display device whose power consumption is reduced.

The switching-over between the impulse mode and the hold mode may not be carried out based on the gray scales. For example, in a gray scale distribution for a first pattern for displaying a mainly-black-and-white display content such as text, the gray scale for displaying white and the gray scale for displaying black are more abundant than the other gray scales. In such a first pattern, the display quality deterioration due to the uneven gray scales is not significant. Thus, the pixel circuit is driven only in the hold mode irrespectively of the gray scales, so that the life of the organic EL element can be prolonged.

On the other hand, a gray scale distribution for a second pattern for displaying a content, such as photos and moving pictures, in which uneven gray scales causes display quality deterioration is a distribution ranged widely over the whole gray scales, for example. In such a second pattern, the pixel circuits are driven both in the impulse mode and the hold mode.

Figure 4:
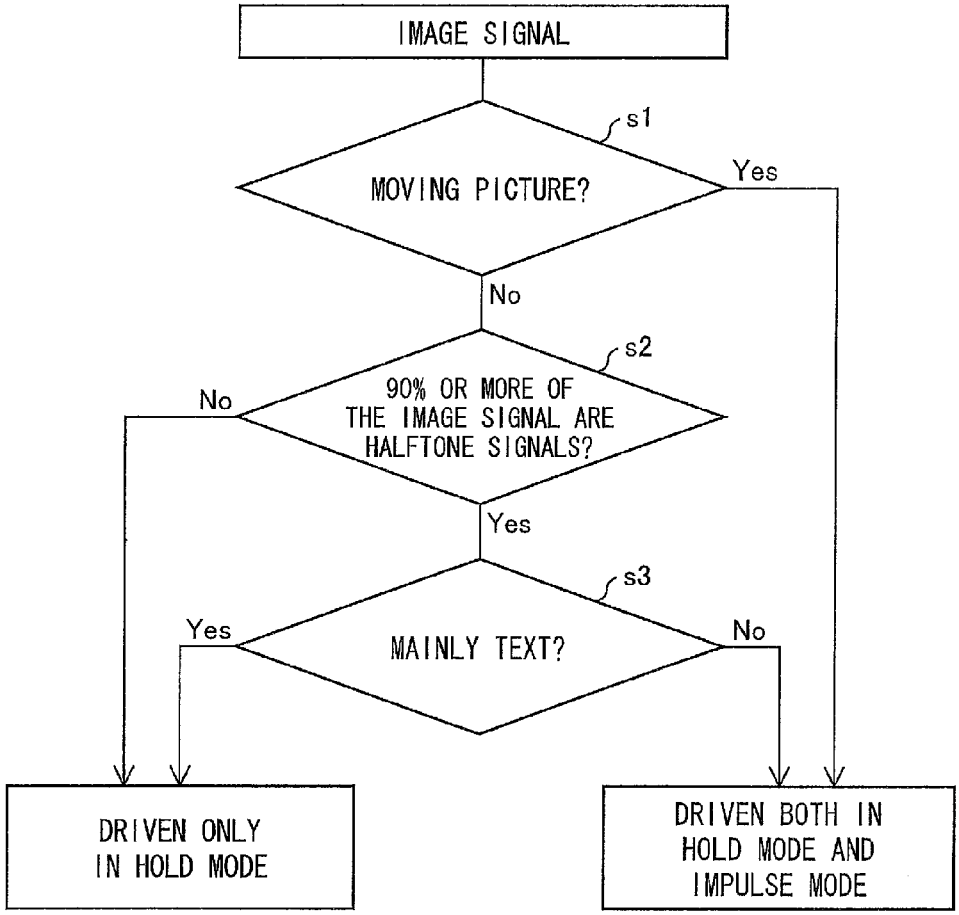
FIG. 4 is a flowchart illustrating how driving only in a hold mode and driving both in an impulse mode and the hold mode are switched over according to an image source.

FIG. 4 illustrates one exemplary flow chart showing how to switch over, according to image sources, the driving method for driving only in the hold mode and the driving method for driving both in the impulse mode and the hold mode. That is, the display device 1 has means for analyzing an image signal, and is configured to switch over the two driving method based on whether an image to be displayed is a moving picture or not, how large an area of the black display, and whether the image to be displayed is mainly text or not.

In the flowchart in FIG. 4, whether the image signal is for a moving picture or not is determined at Step s1. If the image signal is for a moving picture (Yes at Step S1), the driving method for driving both in the impulse mode and the hold mode is employed.

If the image signal is not for a moving picture (No at Step s1), it is determined whether or not signals for intermediate-lengths accounts for 90% or more of the image signal (Step s2), in order to determine whether the area of the black display is large or small. If the signals for the intermediate-lengths accounts for less than 90% of the image signal (No at Step s2), the driving method for driving only in the hold mode is employed.

If the signals for the intermediate-lengths accounts for 90% or more of the image signal (Yes at Step s2), then it is determined whether or not the image to be displayed based on the image signal is mainly text (Step s3). If the image to be displayed based on the image signal is mainly text (Yes at Step s3), the driving method for driving only in the hold mode is employed. If the image to be displayed based on the image signal is not mainly text (No at Step s3), the driving method for driving both in the impulse mode and the hold mode is employed.

As described above, the two driving methods can be selected only be switching over the signal current sources. Therefore, no special control is necessary to change the control every time the type of the image to be displayed is switched over.

As described above, the gray scale distribution of the gray scales constituting the image to be displayed can be the criterion to switch over the impulse mode and the hold mode, that is, to switch over whether to drive the pixel circuit 6 both in the impulse mode and the hold mode, or to drive only in the hold mode. The source driver circuit 2 may have the criterion, or the control circuit 5 may have the criterion.

Example 2

Another Example of the present invention is described below, referring to FIGS. 5 and 6. Example 2 has a configuration identical with that of Example 1, except what is described herein. For the sake of easy explanation, members having functions like those of the members illustrated in the drawings for Example 1 are like numbered and their explanation is not repeated here.

Figure 5:
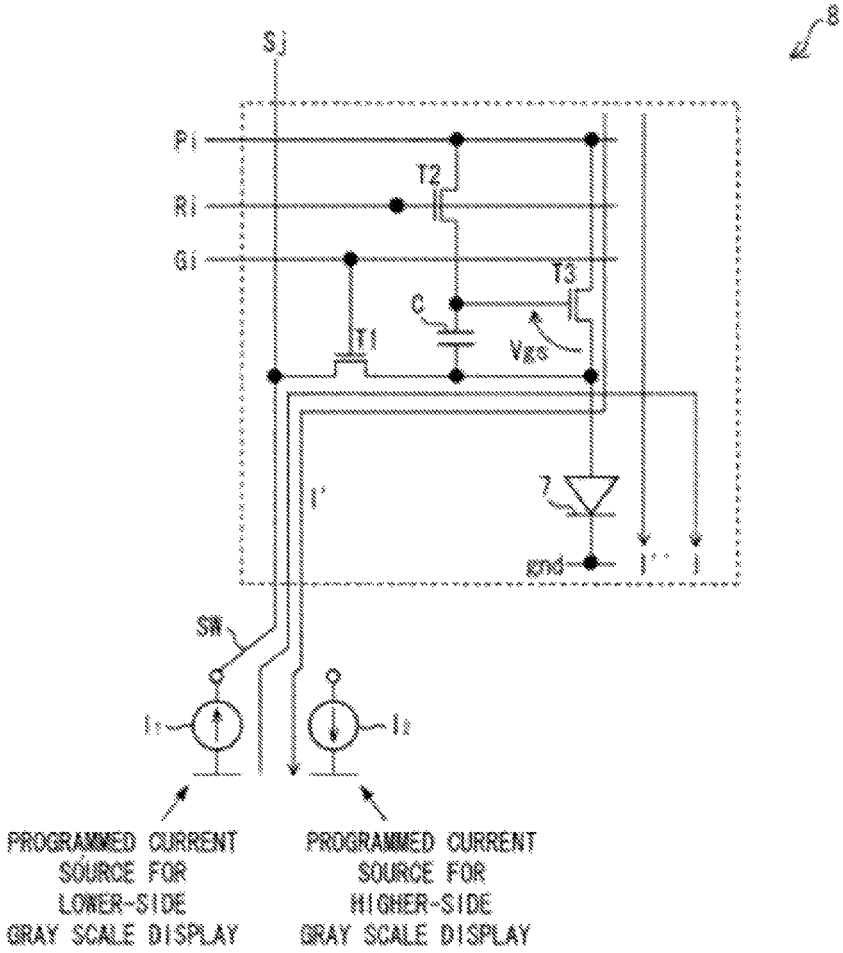
FIG. 5 is a circuit diagram of a pixel circuit according to another Example of the present invention.

FIG. 5 is a circuit diagram of a pixel circuit 8 according to Example 2. The pixel circuit 8 is different from the pixel circuit 6 of Example 1 in terms of the following point.

The pixel circuit 6 of Example 1, the drain of the TFT T2 is electrically grounded, and the drain of the TFT T3 is connected to the power source Vp.

Figure 6:
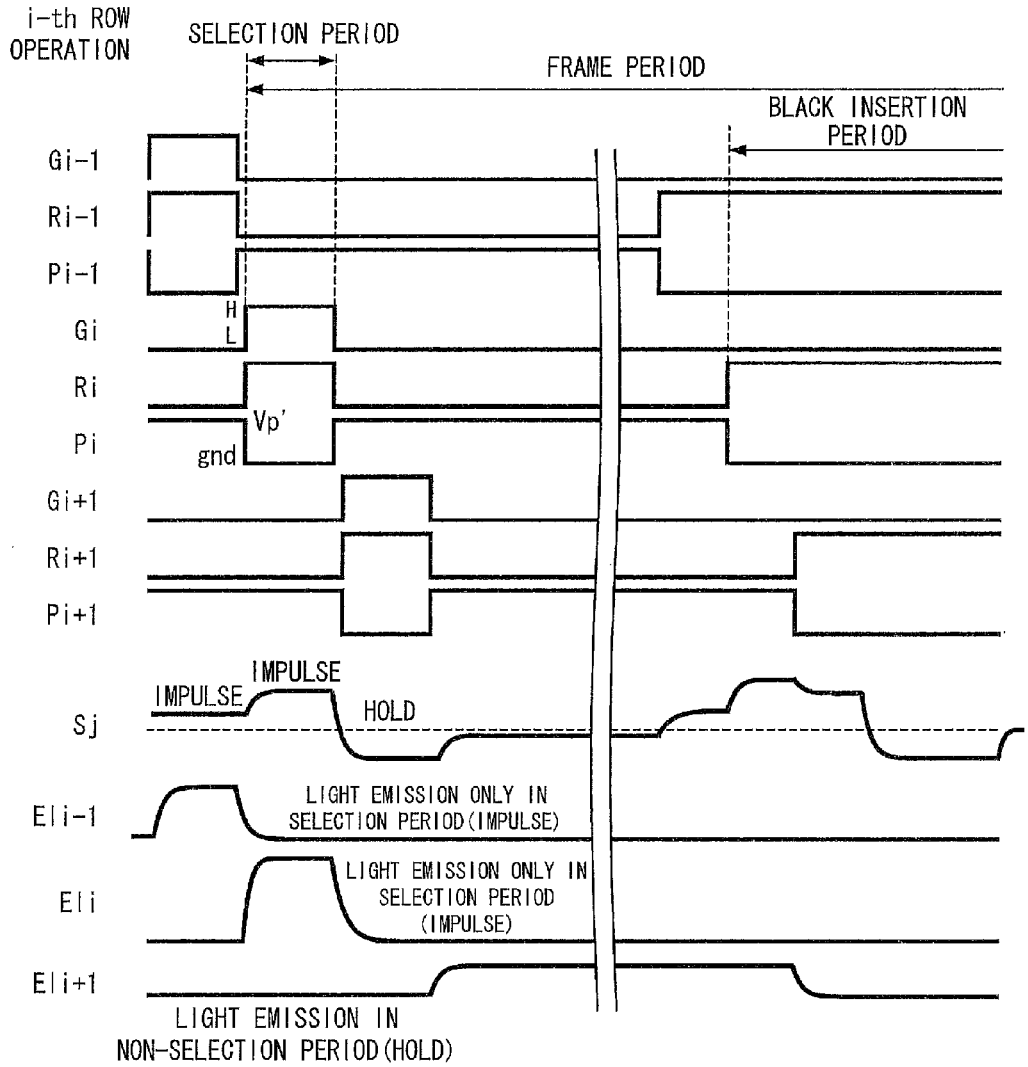
FIG. 6 is a timing chart showing operation of the pixel circuit according to the another Example of the present invention.

On the other hand, the pixel circuit 8 of Example 2 is configured such that a drain of a TFT T2 and a drain of a TFT T3 are connected to a common power source line Pi, whose potential is, as illustrated in a timing charge of FIG. 6, a ground potential during the selection period, but is a potential Vp' during the non-selection period, where the potential Vp' is greater than the grounding potential.

With this configuration, the pixel circuit 8 is not only capable of operating in the same way as the pixel circuit 6 of Example 1, but also capable of commonly utilizing the common power source line Pi instead of separately using the power source line for the ground potential and the power source line for the potential Vp' greater than the ground potential. By this, it is possible to reduce the number of the power source lines by one per row.

Example 3

Still another Example of the present invention is described below referring to FIGS. 7 and 8. Example 3 has a configuration identical with those of Examples 1 and 2, except what is described herein. For the sake of easy explanation, members having functions like those of the members illustrated in the drawings for Example 1 or 2 are like numbered and their explanation is not repeated here.

Figure 7:
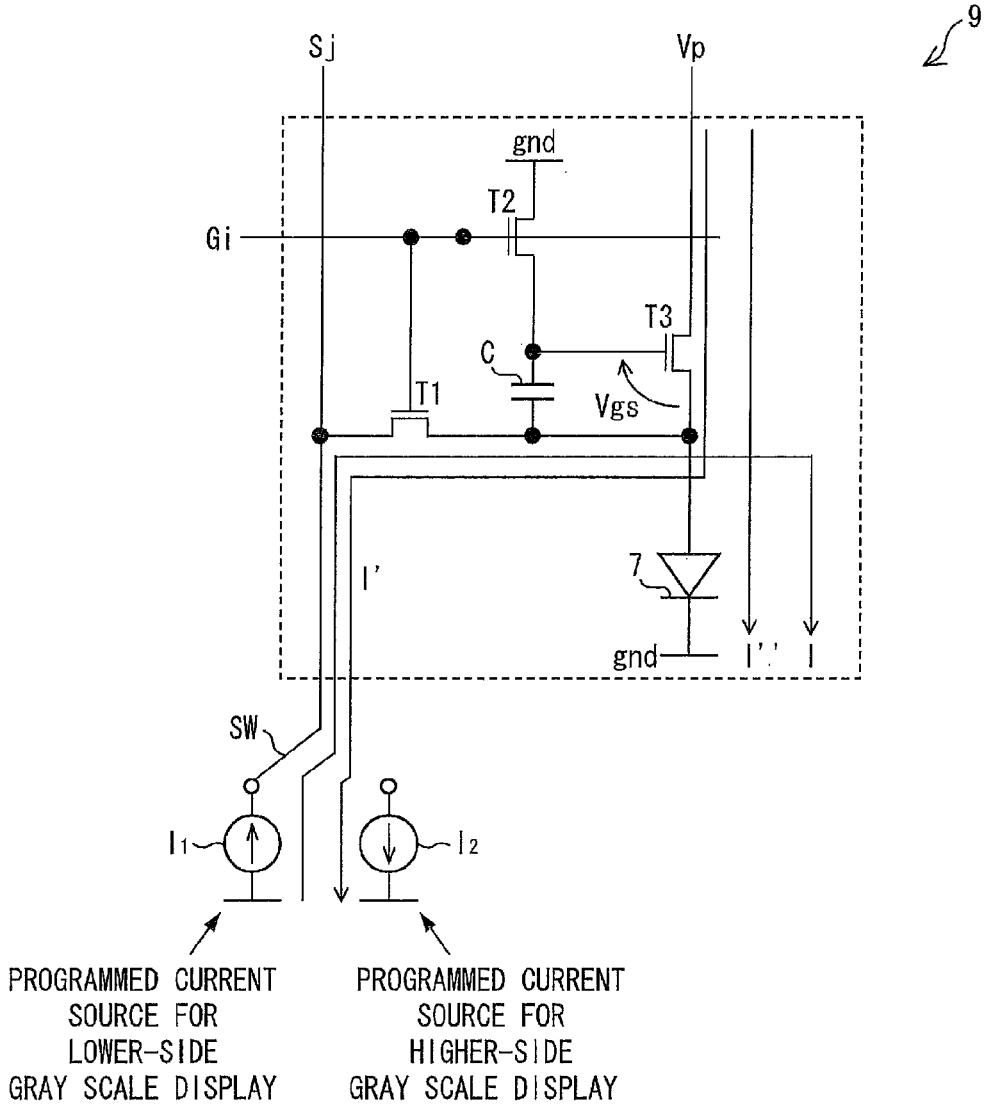
FIG. 7 is a circuit diagram of a pixel circuit according to still another Example of the present invention.

FIG. 7 is a circuit diagram of a pixel circuit 9 according to Example 3. The pixel circuit 8 is different from the pixel circuit 6 of Example 1 in the following points.

In the pixel circuit 6 according to Example 1, the gate of the TFT T1 is connected to the i-th scanning line Gi, and the gate of the TFT T2 is connected to the i-th scanning line Ri.

On the other hand, the pixel circuit 9 of Example 3 is configured such that a gate of a TFT T1 and a gate of a TFT T2 are connected to an i-th scanning line Gi, commonly.

With this configuration, the pixel circuit 9 is not only capable of perform the same no-black-insertion operation which the pixel circuit 6 of Example 1 performs, but also capable of using the scanning line Gi commonly. By this, it is possible to reduce the number of the scanning line by one per row.

Figure 8:
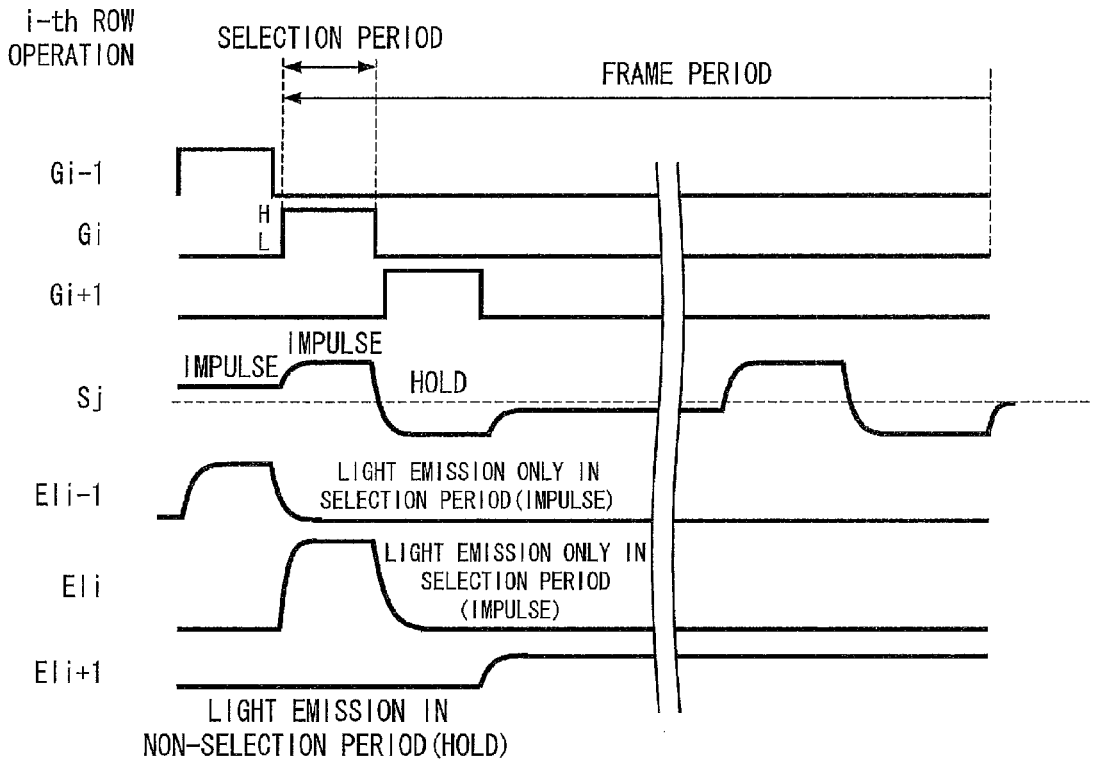
FIG. 8 is a timing chart showing operation of the pixel circuit according to the still another Example of the present invention.
Figure 9:
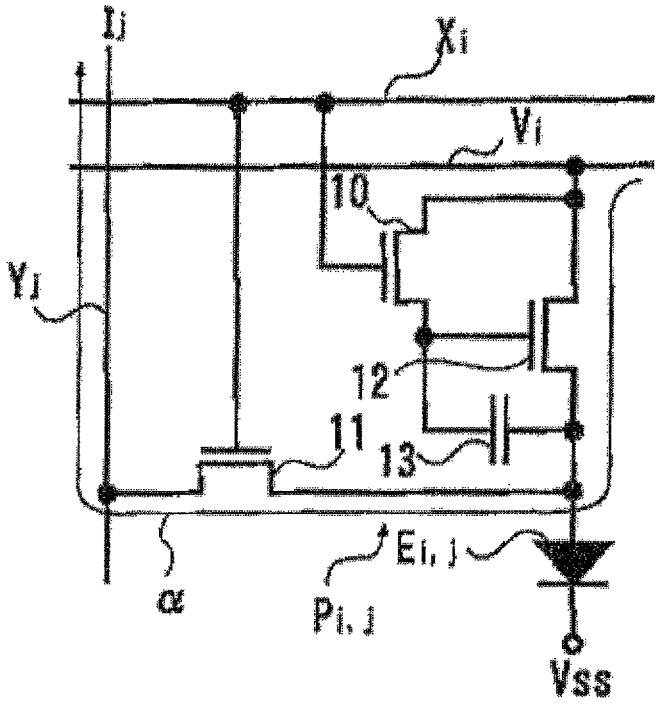
FIG. 9 is a circuit diagram of a conventional driving circuit described in Patent Literature 1.

FIG. 8 is a timing chart illustrating an operation of the pixel circuit 9 according to Example 3. Unlike the timing chart of FIG. 3, the timing chart of FIG. 8 has no waveform of the scanning line Ri.

It should be noted that the pixel circuits 6, 8, and 9 of the present embodiment is applicable not only to an organic EL diode 7 but also to a semiconductor light emitting diode.

Moreover, the display device 1 may be configured such that the programmed current source I1 for the lower-side gray scale display and the programmed current source I2 for the higher-side gray scale display are current sources for outputting the currents in opposite directions.

Further, instead of the current sources I1 and I2, the display device 1 may use voltage sources one of which shows a positive voltage change in response to a gray scale change, and another one of which shows a negative voltage change in response to the gray scale change.

Further, the display device 1 may be configured such that the driving in the impulse mode is carried out for lower-side gray scales and the driving in the hold mode is carried out for higher-side gray scales, where the whole gray scales of the programmed current I or I' are classified into the lower-side gray scales and the higher-side gray scales.

Further, the display device 1 may be configured such that the lower-side gray scales are ranged from a lowest gray scale of the whole gray scales of the light emitting signal to a gray scale smaller than a ½ gray scale which is a center gray scale at the middle of the whole gray scales of the programmed current I, and the higher-gray scales are ranged from the gray scale smaller than the ½ gray scale, to a highest gray scale of the whole gray scales of the light emitting signal.

Further, according to the display device 1 according to the present embodiment, the combinational use of the impulse mode and the hold mode provides a wider color reproducible range both on the lower-gray scale side and the higher-gray scale side. Therefore, the whole color reproducible range achieved by color combination can be dramatically widened.

SUMMARY OF EMBODIMENT

The display device 1 may be configured such that: the plurality of scanning lines encompass a plurality of scanning lines G1, G2, . . . , Gn, Gi and a plurality of scanning lines R1, R2, . . . , Rn, Ri; the pixel circuit 6 includes a thin film transistor T1, a thin film transistor T2, a thin film transistor T3, and a capacitor C; the thin film transistor T1 has a gate connected with the scanning line Gi, and a source connected with the data signal line Sj; the thin film transistor T2 has a gate connected with the scanning line Ri, a drain being electrically grounded, and a source connected with a gate of the thin film transistor T3 and with one end of the capacitor C; the thin film transistor T3 has a drain connected with a power source line Vp, a source connected with a drain of the thin film transistor T1, with another end of the capacitor C, and with an anode of the organic EL diode 7; the organic EL diode 7 has a cathode being electrically grounded; the source driver circuit 3 has the programmed current source I1 for the lower-side gray scale display, the programmed current source I2 for the higher-side gray scale display, and a switch SW; and for the pixel A11, . . . A1*m*, . . . An1, . . . Anm, or Aij displaying an image in the impulse mode, the switch SW connects a corresponding one of the data signal lines S1, S2, . . . , Sm, Sj with the programmed current source I1, and for a pixel A11, . . . A1*m*, . . . An1, . . . , Anm, or Aij displaying an image in the hold mode, the switch SW connects a corresponding one of the data signal lines S1, S2, . . . , Sm, Sj with the programmed current source I2.

In the selection period, the signal level of the scanning line Gi and the signal level of the scanning line Ri are at the high level. By this, in the impulse mode, the programmed current I is supplied in the following route: the programmed current source I1 for the lower-side gray scale display→the data signal line Sj→the source of the TFT T1→the drain of the TFT T1→the anode of the organic EL diode 7→the cathode of the organic EL diode 7. Thereby, the organic EL diode 7 emits light.

In the hold mode, a reversely biased voltage is applied on the organic EL diode 7 during the selection period, thereby turning off the organic EL diode 7. Meanwhile, the gate-source voltage of the TFT T3 becomes positive, thereby turning on the TFT T3.

Therefore, the programmed current I' is supplied in the following route: the power source line Vp→the drain of the TFT T3→the source of the TFT T3→the drain of the TFT T1→the source of the TFT T1→the data signal line Sj→the programmed current source I2 for the higher-side gray scale display.

Because the capacitor C is charged with the gate-source voltage during the selection period of the TFT T3, the gate-source voltage of the TFT T3 during the selection period is maintained after the end of the selection period. Because of this, the TFT transistors T1 and T2 are turned off after the end of the selection period, but the TFT T3 is kept on after the end of the selection period.

Thus, the programmed current I", whose ampere value is substantially identical with that of the programmed current I', is supplied in the following route: the power source line Vp→the drain of the TFT T3→the source of the TFT T3→the anode of the organic EL diode 7→the cathode of the organic EL diode 7.

In case black is inserted after the end of the selection period, the signal level of the scanning line Gi is low and the signal level of the scanning line Ri is high. By this, the TFT T1 is turned off and the TFT T2 is turned on. The TFT T3 is turned off, while the TFT T2 is turned on. The TFT T3 is turned off because the gate potential of the TFT T3 is electrically grounded by turning on the TFT T2. Because TFT T3 is turned off, the programmed current I" is not supplied, thereby turning off the organic EL diode 7.

Therefore, it becomes possible to arrange such that, in case where the gray scale of the programmed current I is a lower-side gray scale, the driving is carried out in the impulse mode, and in case where the gray scale of the programmed current I is a higher-side gray scale, the driving is carried out in the hold mode.

The display device 1 may be configured such that: the plurality of scanning lines encompass a plurality of scanning lines G1, G2, . . . , Gn, Gi, and a plurality of scanning lines R1, R2, . . . , Rn, Ri; the pixel circuit 8 includes a thin film transistor T1, a thin film transistor T2, a thin film transistor T3, and a capacitor C; the thin film transistor T1 has a gate connected with the scanning line Gi, and a source connected with the data signal line Sj; the thin film transistor T2 has a gate connected with the scanning line Ri, a drain connected with a common power source line Pi, and a source connected with a gate of the thin film transistor T3 and with one end of the capacitor C; the thin film T3 transistor has a drain connected with the common power source line Pi, a source connected with a drain of the thin film transistor T1, with another end of the capacitor C, and with an anode of the organic EL diode 7; the organic EL diode 7 has a cathode being electrically grounded; the source driver circuit 3 has the programmed current source I1 for the lower-side gray scale display, the programmed current source I2 for the higher-side gray scale display, and a switch SW; for the pixel A11, . . . , A1*m*, . . . , An1, . . . , Anm, or Aij, displaying an image in the impulse mode, the switch SW connects a corresponding one of the data signal lines S1, S2, . . . , Sm, Sj, with the current source I1, and for the pixel A11, . . . , A1*m*, . . . , An1, . . . , Anm, or Aij, displaying an image in the hold mode, the switch SW connects a corresponding one of the data signal lines S1, S2, . . . , Sm, Sj, with the current source I2; and the common power source line Pi has a ground potential during the selection period, and an potential greater than the ground potential not during the selection period.

With this configuration, the pixel circuit 8 is not only capable of operating in the same way as the pixel circuit 6 configured such that the drain of the TFT T3 is connected to the power source line Vp, but also capable of commonly utilizing the common power source line Pi instead of separately using the power source line for the ground potential and the power source line for the potential Vp' greater than the ground potential. By this, it is possible to reduce the number of the power source lines by one per row.

The display device 1 may be configured such that: the pixel circuit 9 includes a thin film transistor T1, a thin film transistor T2, a thin film transistor T3, and a capacitor C; the thin film transistor T1 has a gate connected with the scanning line Gi, and a source connected with the data signal line Sj; the thin film transistor T2 has a gate connected with the scanning line Gi, a drain being electrically grounded, and a source connected with a gate of the thin film transistor T3 and with one end of the capacitor C; the thin film transistor T3 has a drain connected with a power source line Vp, a source connected with a drain of the thin film transistor T1, with another end of the capacitor C, and with an anode of the organic EL diode 7; the organic EL diode 7 has a cathode being electrically grounded; the source driver circuit 3 has the programmed current source I1 for the lower-side gray scale display, the programmed current source I2 for the higher-side gray scale display, and a switch SW; and for the pixel A11, . . . , A1*m*, . . . , An1, . . . , Anm, or Aij displaying an image in the impulse mode, the switch SW connects a corresponding one of the data signal lines S1, S2, . . . , Sm, Sj with the programmed current source I1, and for the pixel A11, . . . , A1*m*, . . . , An1, . . . , Anm, or Aij displaying an image in the hold mode, the switching means connects a corresponding one of the data signal lines with the programmed current source I2.

As described above, the pixel circuit 9 is configured such that the gate of the TFT T1 and the gate of the TFT T2 are connected to the scanning line Gi, commonly.

With this configuration, the pixel circuit 9 is not only capable of perform the same no-black-insertion operation which the pixel circuit 6 or 8 using the scanning lines Gi and Ri performs, but also capable of using the scanning line Gi commonly. By this, it is possible to reduce the number of the scanning line by one per row.

The display device 1 may be configured such that the programmed current source I1 and the programmed current source I2 are current sources configured to output currents in opposite directions.

With this configuration, the current (the first current) flowing in the data signal lines S1, S2, . . . Sm, Sj in the impulse mode flow in a direction opposite to that of the current (the second current) flowing in the data signal lines S1, S2, . . . Sm, Sj in the hold mode. By this, it becomes possible to distinguish the impulse mode and the hold mode from each other. Thus, it becomes possible to continue the light emission until the end of the selection period even in case of the impulse mode.

Both in the impulse mode and hold mode, the data output can be in the same timing as the start and end of the selection period. Thus, it is not necessary to complicate the circuit for controlling the timing of the data output.

Further, the luminance of the organic EL element 7 is controlled by the current directly flowing the organic EL element 7. Therefore, it is possible to attain uniform luminance distribution that is not influenced by unevenness (individual differences) of the driving TFTs used for driving the pixel circuit.

The display device 1 may be configured such that the programmed current source I1 and the programmed current source I2 are voltage sources one of which shows a positive voltage change in response to a gray scale change, and another one of which shows a negative voltage change in response to the gray scale change.

The display device 1 may be configured such that the thin film transistor T1, the thin film transistor T2, and the thin film transistor T3 are N-channel thin film transistors.

This allows to employ an amorphous silicon panel in the display device 1, which amorphous silicon panel has a difficulty of adopting P-channel TFTs.

The display device 1 may be configured such that the driving in the impulse mode is carried out for lower-side gray scales and the driving in the hold mode is carried out for higher-side gray scales, where whole gray scales of the light emitting signal are classified into the lower-side gray scales and the higher-side gray scales.

In addition, the drive method for the display device may be arranged such that the step of driving in the impulse mode is carried out for lower-side gray scales and the step of driving in the hold mode is carried out for higher-side gray scales where the whole gray scales of the programmed currents I, I', and I" are classified into the lower-side gray scales and the higher-side gray scales.

The display device 1 may be configured such that the lower-side gray scales are ranged from a lowest gray scale of the whole gray scales of the programmed currents I, I', and I", to a gray scale smaller than a ½ gray scale which is a center gray scale at the middle of the whole gray scales of the programmed currents I, I', and I", and the higher-gray scales are ranged from the gray scale smaller than the ½ gray scale, to a highest gray scale of the whole gray scales of the programmed currents I, I', and I".

In addition, the drive method for the display device may be arranged such that the lower-side gray scales are ranged from a lowest gray scale of the whole gray scales of the programmed currents I, I', and I" to a gray scale smaller than a ½ gray scale which is a center gray scale at the middle of the whole gray scales of the programmed currents I, I', and I", and the higher-gray scales are ranged from the gray scale smaller than the ½ gray scale, to a highest gray scale of the whole gray scales of the programmed currents I, I', and I".

Further, the display device 1 may be configured such that the source driver circuit 3 has a criterion on whether to drive the pixel circuits 6 both in the impulse mode and the hold mode, or to drive the pixel circuits 6 only in the hold mode, where the criterion is based on a distribution of gray scale values constituting the image.

For example, in a gray scale distribution for a first pattern for displaying a mainly-black-and-white display content such as text, the gray scale for displaying white and the gray scale for displaying black are more abundant than the other gray scales. In such a first pattern, the display quality deterioration due to the uneven gray scales is not significant. In this case, it is possible to drive the pixel circuit 6 only in the hold mode, irrespectively of the gray scales, in order to achieve low power consumption.

On the other hand, a gray scale distribution for a second pattern for displaying a content, such as photos and moving pictures, in which uneven gray scales causes display quality deterioration is a distribution ranged widely over the whole gray scales, for example. In such a second pattern, the pixel circuit 6 is driven both in the impulse mode and the hold mode.

INDUSTRIAL APPLICABILITY

The present invention makes it possible to perform the gray scale control more easily than conventional gray scale control, to prolong the life of the device by lowering the instant luminance, and to improve moving picture displaying performance. Thus, the present invention is suitably applicable to display devices for full-color image display operation.

REFERENCE SIGNS LIST

1: Display Device
2: Source Driver Circuit
3: Gate Driver Circuit
4: Display Section
5: Control Circuit
6, 8, 9: Pixel Circuit
7: Organic EL Diode (Element, Organic Electroluminescence Diode)
A11, . . . , A1*m*, . . . , An1, . . . , Anm, Aij: Pixels
C: Capacitor
G1, G2, . . . , Gn, Gi: Scanning Lines (First Scanning Line)
R1, R2, . . . , Rn, Ri: Scanning Lines (Second Scanning Line)
I: Programmed Current (Light Emitting Signal)
I': Programmed Current (Light Emitting Signal)
I": Programmed Current (Light Emitting Signal)
I1: Programmed Current Source for Lower-Side Gray Scale Display (First Signal Source)
I2: Programmed Current Source for Higher-Side Gray Scale Display (Second Signal Source)
Pi: Common Power Source Line
s1 to s3: Steps
S1, S2, . . . , Sm, Sj: Data Signal Lines
SW: Switch (Switch Means)
T1: Thin Film Transistor (First Thin Film Transistor)
T2: Thin Film Transistor (Second Thin Film Transistor)
T3: Thin Film Transistor (Third Thin Film Transistor)
Vgs: Gate-Source Voltage
Vp: Power Source Line
Vp': Potential Greater than Ground Potential

The invention claimed is:

1. A display device including a plurality of scanning lines extended in one direction, a plurality of data signal lines extended in another direction, a source driver circuit for driving the plurality of data signal lines, a gate driver circuit for controlling the plurality of scanning lines, and a pixel provided correspondingly to each intersection between the plurality of scanning lines and the plurality of data signal lines, each pixel being provided with an element for emitting light with luminance depending on an electric current supplied to the element, where a selection period of a scanning line is a period in which the scanning line is selected by the gate driver circuit, the display device comprising:

a pixel circuit per pixel, the pixel circuit configured to be driven in an impulse mode in which the element emits the light only during the selection period, and in a hold mode in which the element emits the light not during the selection period but after the selection period, in a case where whole gray scales of a light emitting signal are classified into lower-side gray scales and higher-side gray scales, the pixel circuit being driven (i) solely in the impulse mode when a display is carried out at a lower-side gray scale indicated by the light emitting signal and (ii) solely in the hold mode when a display is carried out at a higher-side gray scale indicated by the light emitting signal, the source driver circuit being provided with a first signal source for supplying the light emitting signal when the pixel circuit is driven in the impulse mode, a second signal source for supplying the light emitting signal when the pixel circuit is driven in the hold mode, and switching means, and for the pixel displaying an image in the impulse mode, the switching means connecting a corresponding one of the data signal lines with the first signal source, and for the pixel displaying an image in the hold mode, the switching means connecting a corresponding one of the data signal lines with the second signal source.

2. A display device as set forth in claim 1, wherein:

the plurality of scanning lines encompass a plurality of first scanning lines and a plurality of second scanning lines;

the pixel circuit includes a first thin film transistor, a second thin film transistor, a third thin film transistor, and a capacitor;

the first thin film transistor has a gate connected with a corresponding one of the first scanning lines, and a source connected with a corresponding one of the data signal lines;

the second thin film transistor has a gate connected with a corresponding one of the second scanning lines, a drain being electrically grounded, and a source connected with a gate of the third thin film transistor and with one end of the capacitor;

the third thin film transistor has a drain connected with a power source line, a source connected with a drain of the first thin film transistor, with another end of the capacitor, and with an anode of the element; and the element has a cathode being electrically grounded.

3. A display device as set forth in claim 1, wherein:

the plurality of scanning lines encompass a plurality of first scanning lines and a plurality of second scanning lines;

the pixel circuit includes a first thin film transistor, a second thin film transistor, a third thin film transistor, and a capacitor;

the first thin film transistor has a gate connected with a corresponding one of the first scanning lines, and a source connected with a corresponding one of the data signal lines;

the second thin film transistor has a gate connected with a corresponding one of the second scanning lines, a drain being connected with a common power source line, and a source connected with a gate of the third thin film transistor and with one end of the capacitor;

the third thin film transistor has a drain connected with the common power source line, a source connected with a drain of the first thin film transistor, with another end of the capacitor, and with an anode of the element;

the element has a cathode being electrically grounded; and the common power source line has a ground potential during the selection period, and an potential greater than the ground potential not during the selection period.

4. A display device as set forth in claim 1, wherein:

the pixel circuit includes a first thin film transistor, a second thin film transistor, a third thin film transistor, and a capacitor;

the first thin film transistor has a gate connected with a corresponding one of the scanning lines, and a source connected with a corresponding one of the data signal lines;

the second thin film transistor has a gate connected with a corresponding one of the scanning lines, a drain being electrically grounded, and a source connected with a gate of the third thin film transistor and with one end of the capacitor;

the third thin film transistor has a drain connected with a power source line, a source connected with a drain of the first thin film transistor, with another end of the capacitor, and with an anode of the element; and the element has a cathode being electrically grounded.

5. A display device as set forth in claim 1, wherein the first signal source and the second signal source are current sources configured to output currents in opposite directions.

6. A display device as set forth in claim 1, wherein the first signal source and the second signal source are voltage sources one of which shows a positive voltage change in response to a gray scale change, and another one of which shows a negative voltage change in response to the gray scale change.

7. A display device as set forth in claim 2, wherein the first thin film transistor, the second thin film transistor, and the third thin film transistor are N-channel thin film transistors.

8. A display device as set forth in claim 1, wherein the lower-side gray scales are ranged from a lowest gray scale of the whole gray scales of the light emitting signal to a gray scale smaller than a ½ gray scale which is a center gray scale at the middle of the whole gray scales of the light emitting signal, and the higher-gray scales are ranged from the gray scale smaller than the ½ gray scale, to a highest gray scale of the whole gray scales of the light emitting signal.

9. A display device as set forth in claim 2, wherein:

the source driver circuit has a criterion on whether to drive the pixel circuits both in the impulse mode and the hold mode, or to drive the pixel circuits only in the hold mode, where the criterion is based on a distribution of gray scale values constituting the image.

10. A display device as set forth in claim 1, wherein the element is an organic electroluminescence diode.

11. A drive method for a display device including a plurality of scanning lines extended in one direction, a plurality of data signal lines extended in another direction, a source driver circuit for driving the plurality of data signal lines, a gate driver circuit for controlling the plurality of scanning lines, and a pixel provided correspondingly to each intersection between the plurality of scanning lines and the plurality of data signal lines, each pixel being provided with an element for emitting light with luminance depending on an electric current supplied to the element, where a selection period of a scanning line is a period in which the scanning line is selected by the gate driver circuit, the drive method comprising:

driving a pixel circuit of the pixel in an impulse mode in which the element emits the light only during the selection period and in a hold mode in which the element emits the light not during the selection period but after the selection period;

in a case where whole gray scales of a light emitting signal are classified into lower-side gray scales and higher-side gray scales, driving the pixel circuit (i) solely in the impulse mode when a display is carried out at a lower-side gray scale indicated by the light emitting signal and (ii) solely in the hold mode when a display is carried out at a higher-side gray scale indicated by the light emitting signal, supplying the light emitting signal from a first signal source when the pixel circuit is driven in the impulse mode; and supplying the light emitting signal from a second signal source when the pixel circuit is driven in the hold mode.

12. A drive method as set forth in claim 11, wherein the lower-side gray scales are ranged from a lowest gray scale of the whole gray scales of the light emitting signal to a gray scale smaller than a ½ gray scale which is a center gray scale at the middle of the whole gray scales of the light emitting signal, and the higher-gray scales are ranged from the gray scale smaller than the ½ gray scale, to a highest gray scale of the whole gray scales of the light emitting signal.

13. A drive method as set forth in claim 11, wherein the element is an organic electroluminescence diode.

* * * * *